United States Patent [19]

Marron

[11] Patent Number: 4,936,181

[45] Date of Patent: Jun. 26, 1990

[54] DOOR HARP

[76] Inventor: John W. Marron, 1724 Madison, Shelton, Wash. 98584

[21] Appl. No.: 294,050

[22] Filed: Apr. 3, 1989

[51] Int. Cl.[5] ..... G10D 1/00

[52] U.S. Cl. ..... 84/173; 116/169

[58] Field of Search ..... 84/173, 290, 408; 116/141, 169; 446/418–422

[56] References Cited

U.S. PATENT DOCUMENTS

| | | | |
|---|---|---|---|
| 515,323 | 2/1894 | Carswell | 84/173 |
| 739,184 | 9/1903 | Keane | 446/421 |
| 2,705,936 | 4/1955 | Garson | 116/169 |

FOREIGN PATENT DOCUMENTS

| | | | |
|---|---|---|---|
| 62030 | 4/1892 | Fed. Rep. of Germany | 84/173 |

*Primary Examiner*—L. T. Hix
*Assistant Examiner*—Brian W. Brown
*Attorney, Agent, or Firm*—Brian J. Coyne

[57] ABSTRACT

A harp is provided for mounting on a swinging door. The harp includes a centrally disposed opening and a plurality of musical strings stretched over the opening. A plurality of mallets is provided for striking the strings when the door undergoes swinging motion, thereby emitting musical tones. Each mallet includes a stiff rod having a mallet head at one end, bearings mounted in tandem on a stiff on a shaft are provided into which the rods insert for oscillatory movement of the mallet heads about the shaft. In contrast to door harp of the prior art, the harp can be mounted on a door with its strings tilted away from horizontal.

1 Claim, 2 Drawing Sheets

FIG. 1A
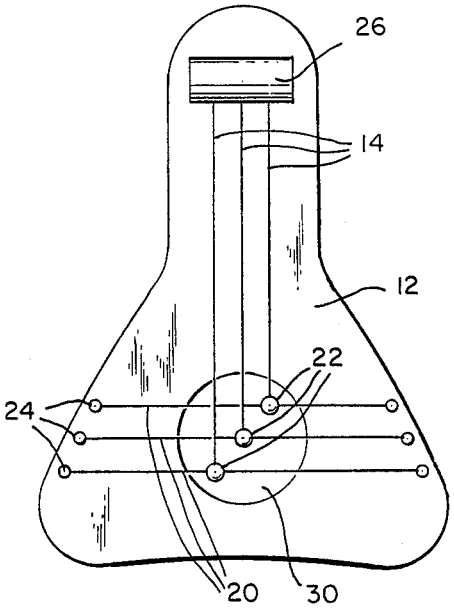
FIG. 1B
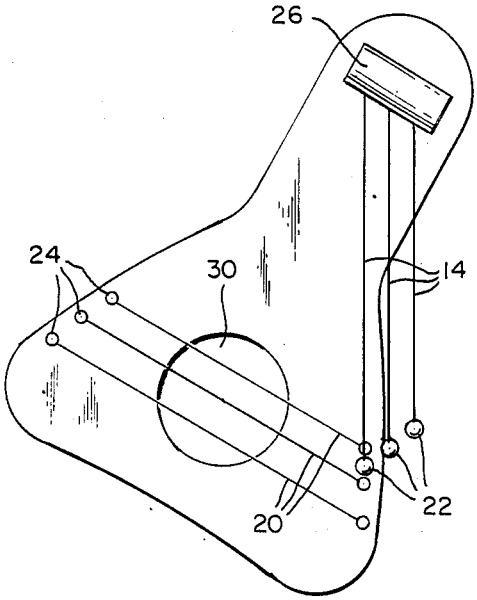
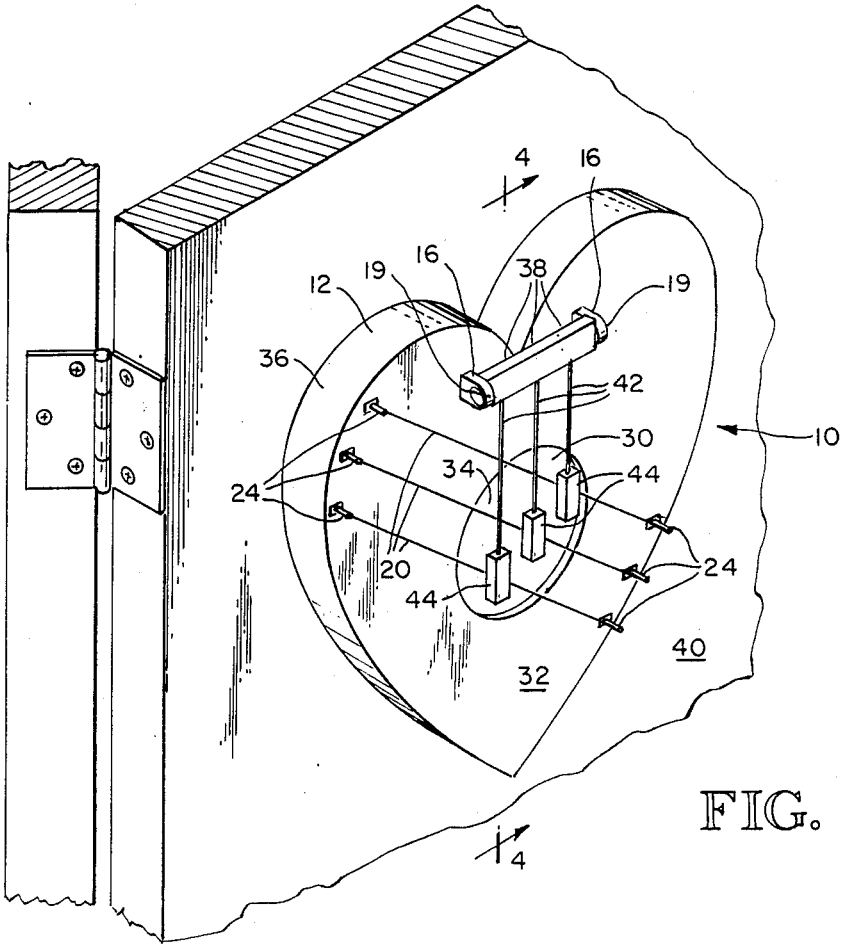
FIG. 2

DOOR HARP

CROSS-REFERENCE TO RELATED APPLICATIONS.

There are no related applications to the United States Patent and Trademark Office.

STATEMENT AS TO RIGHTS TO INVENTIONS MADE UNDER FEDERALLY SPONSORED RESEARCH AND DEVELOPMENT (IF ANY).

No Federally sponsored research and development was involved in applicant's Door Harp invention.

BACKGROUND OF THE INVENTION.

This invention relates to the field of devices for the emission of sounds caused by the opening and closing movements of a swinging door; more particularly, the field of devices commonly known as door harps having a set of musical strings mounted in parallel over a hollow sound box for emitting tones that signal the movement of a swinging door.

DESCRIPTION OF THE PRIOR ART.

In the prior art, door harps have been mounted on swinging doors for the signalling of the entrance or exit of a person through a swinging door by the emission of tones. Such door harps have generally comprised a sound box made from wood, metal or plastic, a set of musical strings mounted in parallel over the sound box, and means for striking the strings in response to swinging movement of the door. The sound box generally serves the purpose of amplifying sounds emitted by the strings in a manner similar to the way the body of a guitar, violin or other string musical instrument increases the volume of the sounds emitted by the strings of those instruments. In the prior art, the means for striking the strings has been weights suspended from flexible cords that allow the weights to swing in the manner of a pendulum when the door upon which the harp is mounted is moved. One weight is provided for each of the strings, and the lengths of the cords are chosen in order to position the weights for swinging contact with the strings when the door harp is oriented with its strings horizontal. But if, for aesthetic or other reasons, the door harp is oriented on the door with its strings no longer horizontal, the weights no longer strike the strings when the door is moved. Compare FIG. 1(*a*) showing the door harp of the prior art with its strings horizontal and its weights at rest against the strings, with FIG. 1(*b*) showing the same door harp rotated such that its strings are tilted away from the horizontal thereby causing its weights to lose contact with its strings.

SUMMARY OF THE INVENTION:

It is, therefore, an object of the present invention to provide a harp for mounting on a swinging door that emits tones when the door is subjected to a swinging motion.

It is another object of the invention to provide a harp for a swinging door that can be mounted on the door with its strings tilted away from horizontal.

BRIEF DESCRIPTION OF THE DRAWINGS.

FIG. 1(*a*) is a front elevational view of the door harp of the prior art at rest with its strings horizontal;

FIG. 1(*b*) is an elevational view of the door harp of FIG. 1(*a*) rotated clockwise such that the strings are tilted away from horizontal and showing that the weights are no longer in contact with the strings;

FIG. 2 shows the door harp mounted on one vertical side of a swinging door showing the mallet heads in contact with the strings;

Figure 4:
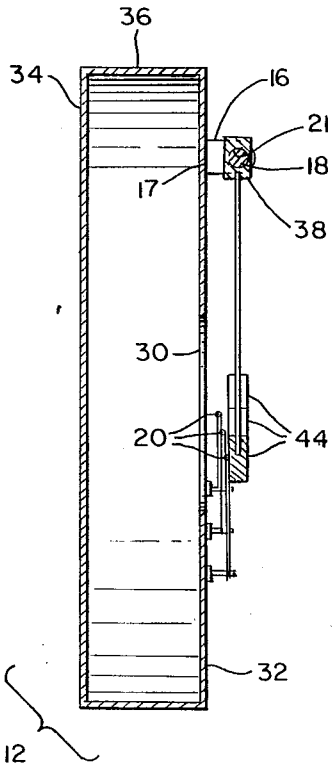
FIG. 4 is a cross-sectional view of my harp taken along line 4—4 of FIG. 2 showing one mallet head in contact with one of the strings.

DESCRIPTION OF THE PREFERRED EMBODIMENT.

Referring now to the drawings wherein like referenced characters designate like parts throughout the several views thereof, there is shown in FIG. 1(*a*) a door harp of the prior art having a hollow soundbox 12 and three taut musical strings 22 mounted in parallel on the soundbox 12 and overlying the centrally disposed opening 30 of the soundbox 12. Each of the strings 22 is wound about a tuning peg 24 for adjusting the tension of the musical strings 22, thereby providing a means for tuning each of the strings 22 to a desired pitch. The prior art door harp illustrated in FIG. 1(*a*) is oriented with its strings 22 horizontal, in which orientation each of the three weights 22 separately suspended from header 26 by flexible cords 14 rest against one of the three strings 20. As shown in FIG. 1(*b*), when the same door harp is rotated to tilt the strings 20 away from horizontal, the weights 22 no longer contact the strings 20.

Referring now to FIG. 2, my door harp, designated generally by the numeral 10, is illustrated in frontal perspective mounted on one side of a swinging door 40. My door harp includes a soundbox 12, preferably hollow, having front 32, rear 34 and side 36 surfaces, and having a centrally disposed opening 30 cut out of its front surface 32. The rear surface 34 of the soundbox 12 is preferably flat for matching the flat surface of the side of the swinging door 40 upon which my door harp is mounted. A plurality of taut, musical strings 20 are stretched over the opening 30 of the soundbox 12. In the illustration, the number of strings is three, but more strings may be included if desired. Means for tuning each string are provided, which means is preferably a pair of tuning pegs 24 inserted into the front surface 32 of the soundbox 12 and on opposite sides of the opening 30, the opposite ends of each string 20 being wound about a tuning peg 24.

Two spaced-apart pillars 16 are attached to the front surface 32 of the soundbox 12. As shown in side elevational view in FIG. 3 and in dotted outline in FIG. 4, which is a crosssectional view of my harp along the line 4—4 of FIG. 2, each pillar 16 has a substantially flat end 17 for mating contact with the front surface 32 of the soundbox 12, and an opposite end 19 projecting away from the said surface 32. Shaft 18 is mounted between the pillars 16 and spans the distance therebetween substantially parallel to the front surface 32. In the preferred embodiment, each of the pillars 16 has a bore 21 into which the shaft 18 is inserted.

My door harp further includes a plurality of bearings 38 equal in number to the number of strings 20. Referring to FIG. 2, three bearings 38 are shown rotatably mounted in tandem on shaft 18: that is, each of the bearings 38 has a bore through which is inserted shaft 18. The shape of the bearings 38 is not critical, but bearings 38 shaped as flat-sided blocks are preferred.

A plurality of mallets is provided equal in number to the number of strings 20. Each mallet is comprised of a stiff rod 42 and a mallet head 44. One end of each of the rods 42 is inserted into a bearing 38 for oscillatory movement therewith about shaft 18. The other end of each rod 42 is inserted into a mallet head 44. The mallet heads 44 are preferably shaped as flat-sided blocks. The length of each rod 42 is chosen so that when my door harp is at rest, as shown in FIGS. 2 and 4, each mallet head 44 will be in close proximity with one of the strings 20.

Figure 3:
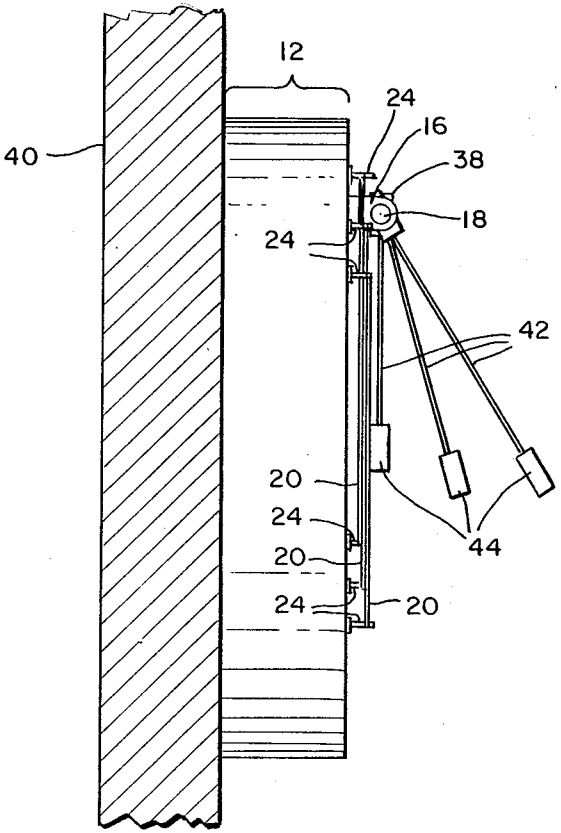
FIG. 3 is a side view of my door harp showing the mallets in oscillatory motion and with the mallet heads temporarily out of contact with the strings.

Referring now to FIG. 3, when the door 40 is subject to swinging movement, the mallet heads 44 are displaced away from the strings and will swing by pendulum action to strike the strings 20, thereby causing the emission of musical tones.

The soundbox 12 can be made of wood, plastic or metal, as can the pillars 16, shaft 18, bearings 38, rods 42 and mallet heads 44. The musical strings 22 can be of any type currently known to persons skilled in the art of stringed musical instruments, but steel strings are preferred. The soundbox 12 can be of any shape so long as its rear surface 34 is flat, but shapes suggesting a guitar, violin, piano and other musical instruments, or natural objects such as sea shells, are preferred for aesthetic reasons. My harp will emit tones regardless of whether the strings 20 are horizontal or not, thereby affording the user flexibility in mounting the harp on a door. The strings 20 can be positioned in parallel array upon the soundbox 12 with any orientation with respect to the soundbox 12, so long as the strings 20 are stretched over the soundbox opening 30. This facilitates modeling various string instruments when constructing my door harp.

It should be understood that the foregoing is only illustrative of my invention as numerous changes can be made therein falling with the spirit and intent of my invention.

I claim:

1. A harp for mounting on a swinging door, comprising:

a soundbox;

a plurality of taut musical strings mounted in parallel over the soundbox;

means for tuning each string to resonate at a desired pitch;

a plurality of spaced-apart mallets equal in number to the number of strings, each mallet comprising a rod having a mallet head at one end;

two spaced-apart pillars, mounted on the soundbox;

a shaft mounted between the pillars; and a plurality of bearings equal in number to the number of strings rotatably mounted in tandem on the shaft; wherein the rod of each mallet is attached to a bearing for oscillatory movement therewith about the shaft, and the length of the rod of each mallet is chosen to position its mallet head for striking contact with a single string, whereby movement of the door causes the strings to emit tones as they are struck by the mallet heads.

* * * * *